US009169683B2

(12) United States Patent
Galliot et al.

(10) Patent No.: US 9,169,683 B2
(45) Date of Patent: Oct. 27, 2015

(54) WINDOW LIFTER COMPRISING A HOLDER FOR FASTENING A CABLE BETWEEN TWO ENDS OF FIRST AND SECOND GUIDE RAILS

(71) Applicants: Nicolas Galliot, Sully sur Loire (FR); Michael Fever, Ouzouer-sur-Loire (FR); Eric Simonneau, Orleans (FR); Stephane Hemond, Les Bordes (FR)

(72) Inventors: Nicolas Galliot, Sully sur Loire (FR); Michael Fever, Ouzouer-sur-Loire (FR); Eric Simonneau, Orleans (FR); Stephane Hemond, Les Bordes (FR)

(73) Assignee: INTEVA PRODUCTS FRANCE SAS (FR)

( * ) Notice: Subject to any disclaimer, the term of this patent is extended or adjusted under 35 U.S.C. 154(b) by 0 days.

(21) Appl. No.: 13/856,654

(22) Filed: Apr. 4, 2013

(65) Prior Publication Data

US 2013/0283697 A1 Oct. 31, 2013

(30) Foreign Application Priority Data

Apr. 10, 2012 (FR) ..... 12 53276

(51) Int. Cl.
*E05F 15/16* (2006.01)
*E05F 11/48* (2006.01)

(52) U.S. Cl.
CPC ..... *E05F 11/488* (2013.01); *E05F 11/486* (2013.01)
USPC ..... 49/349; 49/348; 49/352; 296/146.5; 296/146.7

(58) Field of Classification Search
CPC ..... E05F 11/488; E05F 11/486; E05F 11/483
USPC ..... 49/348, 349, 352; 296/146.5, 146.7
See application file for complete search history.

(56) References Cited

U.S. PATENT DOCUMENTS

| | | | | |
|---|---|---|---|---|
| 6,397,524 | B1 * | 6/2002 | Sakaguchi et al. | 49/375 |
| 6,910,730 | B2 * | 6/2005 | Kinoshita et al. | 296/146.16 |
| 7,263,804 | B2 * | 9/2007 | Ishii et al. | 49/352 |
| 7,802,401 | B2 * | 9/2010 | Wild et al. | 49/375 |
| 7,877,932 | B2 * | 2/2011 | Kriese et al. | 49/352 |
| 2003/0009948 | A1 * | 1/2003 | Nishikawa et al. | 49/502 |
| 2003/0233791 | A1 | 12/2003 | Benoit et al. | |
| 2004/0154227 | A1 * | 8/2004 | Yoshimura | 49/352 |
| 2005/0011130 | A1 | 1/2005 | Klippert et al. | |
| 2005/0188621 | A1 * | 9/2005 | Kinoshita et al. | 49/352 |
| 2007/0000178 | A1 * | 1/2007 | Wild et al. | 49/352 |

(Continued)

FOREIGN PATENT DOCUMENTS

| | | | |
|---|---|---|---|
| EP | 1302617 | A1 | 4/2003 |
| EP | 1 432 885 | B1 | 12/2005 |

(Continued)

OTHER PUBLICATIONS

Preliminary Search Report dated Nov. 23, 2012.

*Primary Examiner* — Katherine Mitchell
*Assistant Examiner* — Marcus Menezes
(74) *Attorney, Agent, or Firm* — Cantor Colburn LLP

(57) ABSTRACT

A window lifter is provided. The window lifter having: first and second guide rails; first and second sliders for driving a window, the first and second sliders being guided in translation by the first guide rail and the second guide rail, respectively; a cable system for driving the sliders along the first and second guide rails, the cable system comprising a cable extending between the first and second guide rails for connecting to corresponding ends of the first and second guide rails, respectively, the first guide rail comprising a holder for fastening the cable between the two corresponding ends of the first and second guide rails that the cable connects.

20 Claims, 1 Drawing Sheet

(56) References Cited

U.S. PATENT DOCUMENTS

| | | | | |
|---|---|---|---|---|
| 2007/0056219 | A1* | 3/2007 | Martinez Morai et al. | 49/502 |
| 2007/0271849 | A1* | 11/2007 | Kriese et al. | 49/348 |

FOREIGN PATENT DOCUMENTS

| | | | |
|---|---|---|---|
| WO | 03031756 | A1 | 4/2003 |
| WO | 2005024165 | A1 | 3/2005 |

* cited by examiner

WINDOW LIFTER COMPRISING A HOLDER FOR FASTENING A CABLE BETWEEN TWO ENDS OF FIRST AND SECOND GUIDE RAILS

CROSS REFERENCE TO RELATED APPLICATIONS

This application claims foreign priority to French Patent Application No. 12 53 276 filed Apr. 10, 2012, under 35 U.S.C. §119, the entire contents of which are incorporated herein by reference thereto.

BACKGROUND

The present invention relates to a window lifter with a cable holder and a vehicle door including such a window lifter.

In the automobile field, one known type of window lifter includes two guide rails for a window, arranged inside a motor vehicle door. These guide rails are substantially parallel to each other and arranged across from each other. The guide rails are traveled by a cable system to allow the translational movement of the window. Known from this type of window lifter is the use of a cable system each joining the ends of one of the guide rails to an opposite end of the other guide rail. Cables thus intersect between the two guide rails. This type of window lifter is called an "X" lifter. The ends of the guide rails joined by a same cable here are designated using the expression "corresponding ends". One drawback of this type of window lifter is that, when the motor vehicle door is closed, the flexibility of the cables can cause a transverse movement of one of the cable. This cable can then come into contact with the walls of the door and create a noise. The noise is more significant as the force exerted to close the door is greater. The comfort desired by the user of the motor vehicle may not be satisfied if such a noise is perceptible by the user. The quality of the motor vehicle may also be questioned by the user. Furthermore, this noise may be interpreted by the user as an anomaly in the door.

One known solution to limit the transverse travel of a cable consists of using a retaining clip, i.e., a retaining piece in the shape of a clamp fastened by elastic deformation. This solution is used in a window lifter device 18, shown in FIG. 1, including first and second guide rails 20 and 22. Sliders 28 allow the driving of a window (not shown). The sliders 28 are guided in translation by the first and second guide rails 20 and 22. The sliders 28 are shown in FIG. 1 in three different operating positions, but, during operation, only two sliders 28 are present on the window lifter 18, one on each guide rail 20 and 22. A cable system for driving the sliders 28 travels through the first and second guide rails 20 and 22. Returns 24 are arranged at the ends of the first and second guide rails 20 and 22 to cooperate with the cable system, respectively. In reference to FIG. 1, a platen 34 is arranged at the first guide rail 20. The platen 34 supports means for driving the cable system, in particular a geared motor 36, to allow the closing and opening of the window by means of the movement of the sliders. To prevent the transverse movements of the cable system, a retaining clip 32 is arranged at the center of a sheath of the cable 30. One end of the holding clip 32 is fastened to a wall of the motor vehicle door (not shown), and another end is fastened to the sheath of the cable 30. In reference to FIG. 1, the illustrated solution has the drawback of causing a complex assembly of the window lifter device 18.

Accordingly, it is desirable to provide a window lifter that limits transverse movements of the cable with a simplified assembly.

SUMMARY OF THE INVENTION

In accordance with one embodiment, a window lifter is provided. The window lifter having: first and second guide rails; first and second sliders for driving a window, the first and second sliders being guided in translation by the first guide rail and the second guide rail, respectively; and a cable system for driving the sliders along the first and second guide rails, the cable system comprising a cable extending between the first and second guide rails for connecting to corresponding ends of the first and second guide rails, respectively, the first guide rail comprising a holder for fastening the cable between the two corresponding ends of the first and second guide rails that the cable connects.

According to various embodiments, one or more of the following features may be provided: the portion of the cable extending between the holder and the end of the first guide rail has a length greater than or equal to 1/10 of the length of the portion of the cable connecting the two corresponding ends of the first and second guide rails; the guide rails define a driving direction of the window, the holder extending between the two ends of the first guide rail, in a direction perpendicular to the driving direction of the window; the first and second guide rails are provided to define, in the operating position of the window lifter, the opposite sides of a parallelogram, the holder being arranged to fasten the cable inside such a parallelogram; in other words, once the two rails are in the operating position of the window lifter, they substantially define the opposite sides of a parallelogram inside which the holder extends for fastening of the cable that connects two opposite corners of the parallelogram through the inside; the first and second guide rails are provided to define, in the operating position of the window lifter, the opposite sides of a parallelogram, the holder being arranged to fasten the cable to the outside of such a parallelogram; in other words once the two rails are in the operating position of the window lifter, they substantially define the opposite sides of a parallelogram outside which the holder extends to fasten the cable that connects two opposite corners of the parallelogram by the outside; the cable includes a sheath to form a "Bowden" cable, the portion of the cable between the holder and the end of the first guide rail not having a sheath; the holder integrates a cable stop; a drum for driving the sliders by means of the cable system; the drum is arranged on the first guide rail at the holder; the holder is suitable for supporting a geared motor for driving the drum; the cable system comprises an additional cable extending between the first and second guide rails while connecting one end of the second guide rail to the drum, the cable and the additional cable at the holder; the distance separating the holder from one end of the first guide rail is greater than or equal to one quarter of the length of the first guide rail; the holder and the first guide rail are integral; and the first and second guide rails are separate pieces.

In another embodiment, a vehicle door is provided, the vehicle door having: an inner door shell, a window and a window lifter as previously described, in which the window lifter is mounted in the inner door shell of the vehicle so as to drive the closing and opening movement of the window.

According to another embodiment, the cable is fastened to the inner door shell by means of first and second guide rails, and does not have other fastening means to the inner door shell.

In yet another embodiment, a vehicle door including an inner door shell, a window and a window lifter is provided. The window lifter of the vehicle door having: first and second guide rails; first and second sliders for driving a window, the first and second sliders being guided in translation by the first guide rail and the second guide rail, respectively; a cable system for driving the sliders along the first and second guide rails, the cable system comprising a cable extending between the first and second guide rails for connecting to corresponding ends of the first and second guide rails, respectively, the first guide rail comprising a holder for fastening the cable between the two corresponding ends of the first and second guide rails that the cable connects, wherein the window lifter is mounted in the inner door shell of the vehicle so as to drive the closing and opening movement of the window.

In yet another embodiment, a window lifter is provided. The window lifter having: first and second guide rails; first and second sliders for driving a window, the first and second sliders being guided in translation by the first guide rail and the second guide rail, respectively; a cable system for driving the sliders along the first and second guide rails, the cable system comprising a cable extending between the first and second guide rails for connecting to corresponding ends of the first and second guide rails, respectively, the first guide rail comprising a holder for fastening the cable between the two corresponding ends of the first and second guide rails that the cable connects, wherein a portion of the cable includes a sheath and another portion of the cable between the holder and the end of the first guide rail does not having the sheath.

BRIEF DESCRIPTION OF THE DRAWINGS

Other features and advantages of the invention will appear upon reading the following description of various embodiments of the invention, provided as an example and in reference to the appended drawings.

DETAILED DESCRIPTION

Various embodiments of the invention relate to a window lifter having first and second guide rails. The window lifter also comprises first and second sliders driving a window. The first and second sliders are guided in translation by the first guide rail and the second guide rail, respectively. The window lifter also comprises a cable system for driving sliders along the first and second guide rails. The cable system comprises a cable extending between the first and second guide rails while connecting two corresponding ends of the first and second guide rails, respectively.

The first guide rail comprises a holder for fastening the cable between the two corresponding ends of the first and second guide rails that the cable connects. In other words, when the cable extends from one end of a guide rail to one end of the other guide rail, the holder maintains the lateral position of the cable of at least one point between the two ends of the guide rails.

This intermediate fastening point provided by the support makes it possible to limit the lateral displacement freedom of the cable. The lateral displacement of the cable is therefore decreased.

This decrease in the lateral displacement of the cable by the proposed window lift is advantageously independent of the integration of the proposed window lift into a motor vehicle door comprising an inner door shell. Thus, no intermediate fastening means for the cable, such as a retaining clip, is necessary to limit the displacement of the cable, during the integration of the window lifter into the door. The assembly of the window lifter is then simplified.

The invention also relates to the vehicle door including the inner door shell with the preceding window lifter. The proposed vehicle door also includes a window, the window lifter being mounted in the inner door shell of the vehicle so as to drive the closing and opening movement of the window. More specifically, the cable can be fastened to the inner door shell by means of the first and second guide rails, and may be provided without other means for fastening to the inner door shell.

Figure 1:
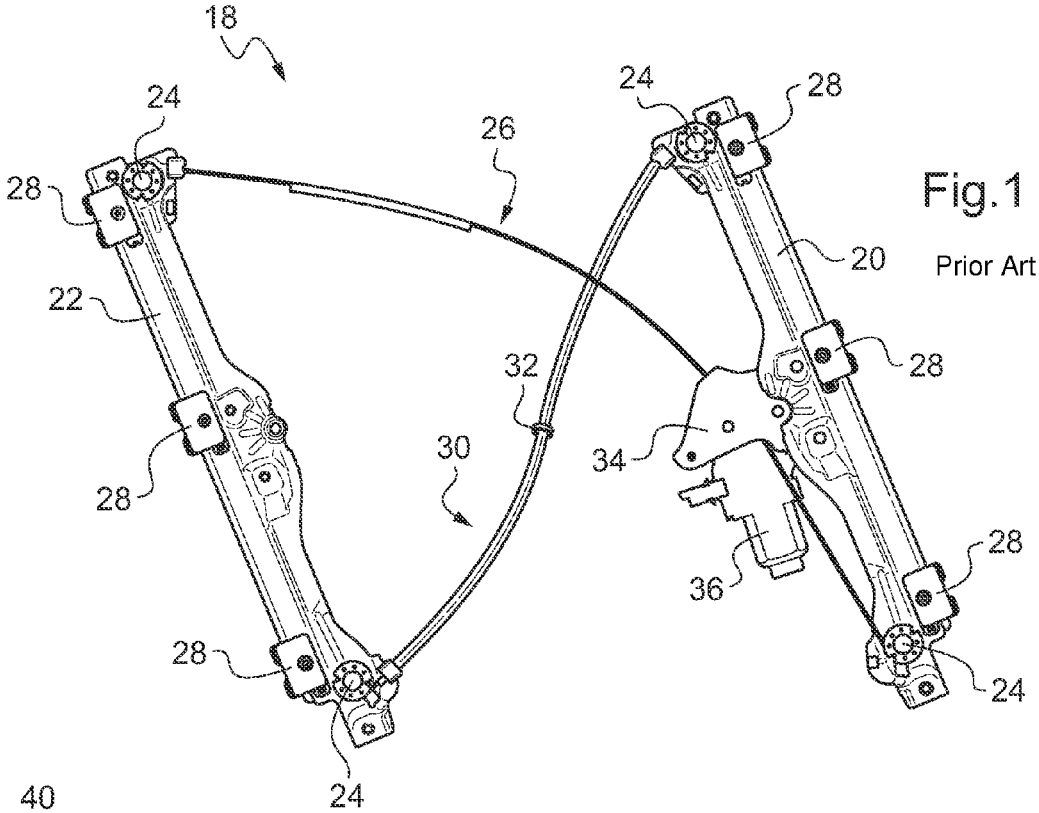
Fig.1 Prior Art
FIG. 1 shows a diagrammatic perspective view of a window lifter device.
Figure 2:
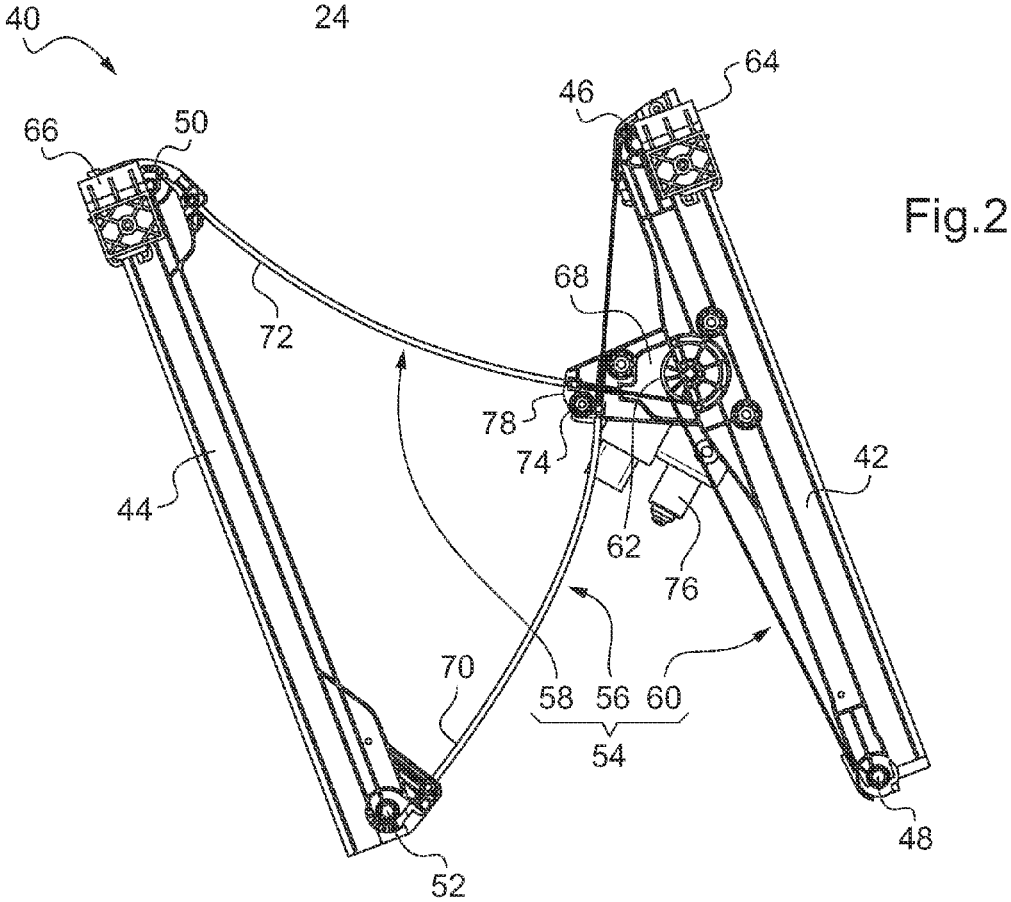
FIG. 2 shows a diagrammatic perspective view of a window lifter device according to various embodiments of the present invention.

FIG. 2 shows a diagrammatic perspective view of one embodiment of the proposed window lifter device 40. As illustrated, the first and second guide rails 42 and 44 are designed as separate, or distinct, pieces or parts. In others words, before assembly in a vehicle door, the first guide rail 42 is mechanically independent from the second guide rail 44, i.e. the guide rails 42 and 44 are not connected one to another by stiff parts before their assembly into the motor vehicle door. It should be mentioned that the shown cables composing the cable system 54 and connecting the guide rails 42 and 44 are not to be considered as stiff parts connecting the guide rails 42 and 44. The mechanical independence of these two guide rails 42 and 44 allows the reduction of the used stiff materials, e.g. plastic or metal, forming the stiff parts of the window lifter as the guide rails. The avoidance of stiff part connecting the guide rails 42 and 44 further reduces the cumbersomeness of the window lifter before and after the assembly and also improves the handling during the assembly of the window lifter into the motor vehicle door by allowing a liberty of movement and arrangement of one of the rails with respect to the other.

FIG. 2 shows the window lifter 40 in a position where the first and second guide rails 42 and 44 are arranged across from each other in the operating position of the window lifter. In other words, the window lifter 40 of FIG. 2 is in the assembled position, the first and second guide rails 42 and 44 respectively extending in substantially parallel directions. Thus, in this operating position, the two guide rails 42 and 44 define the opposite sides of a parallelogram.

In the assembled position, a window, not shown, is suitable for cooperating with the first and second sliders 64 and 66 guided in translation, respectively by the first and second guide rails 42 and 44. More particularly, the window may be directly fastened to the sliders 64 and 66. The window thus follows the movement of the first and second sliders 64 and 66. In other words, the guide rails 42 and 44 define a driving direction of the window. To improve the guiding of the sliders, the sliders 64 and 66 are preferably form-fitted with the first and second guide rails 42 and 44, respectively.

In reference to FIG. 2, the window lifter 40 comprises a drum 62 for driving the sliders 64 and 66 by means of the cable system 54. The drum 62 here is arranged on the first guide rail 42 at the holder 68. The holder 68 then advantageously performs the function of the platen of the prior art as well as a fastening point for fastening the cable 56 between the two corresponding ends of the first and second guide rails 42 and 44. In compliance with this platen function of the holder 68, the holder 68 can be suitable for supporting a geared motor 76 for driving the drum 62.

In one preferred embodiment, the holder 68 and the first guide rail 42 can be integral, i.e., form a single piece. According to this embodiment, the holder 68 and the guide rail 42 are for example made by stamping sheet metal or injecting metal or plastic.

In the case where the holder 68 is provided to support the geared motor, it is preferable for the first guide rail 42 comprising the holder 68 to be, among the two guide rails 42 and 44, that which is provided to be closest to a hinge of the door in which the window lifter is to be mounted. For example, when the door opens toward the front of the vehicle, the first guide rail 42 is advantageously provided to be arranged at the front of the door in which the window lifter is mounted. In this way, the forces undergone by the geared motor during slamming of the door to close it are minimized.

To orient the cable system 54 and ensure proper transmission of movement between the drum 62 and the sliders 64 and 66, the first and second guide rails 42 and 44 can include returns 46, 48, 50 and 52. More particularly, the returns 46, 48, 50 and 52 can be pulleys to limit the friction due to the displacement of the cable system 54. As shown in FIG. 2, the returns 46, 48, 50 and 52 are preferably arranged at each of the ends of the first and second guide rails 42 and 44, respectively, to benefit from the entire length of the rails 42 and 44 to profit the guiding of the sliders 64 and 66 and therefore the window. Thus, the cable 56 connecting the two corresponding ends of the first and second guide rails 42 and 44, respectively, extends between a return 46 on the first guide rail 42 and a return 52 on the second guide rail 44. The returns 46 and 52 are thus arranged at the two corresponding ends of the first and second guide rails 42 and 44, respectively.

Depending on the arrangement of the holder 68 relative to the parallelogram defined by the assembly position of the window lifter, two alternative embodiments are proposed. FIG. 2 illustrates the first of these two embodiments, with the holder 68 fastening the cable 56 inside the parallelogram. The cable 56 then extends through the inside of the parallelogram between the pulleys 46 and 52 of the corresponding ends of the first and second guide rails 42 and 44. When the holder 68 performs the platen function, the geared motor 76 protrudes inside the parallelogram, advantageously making it possible to reduce the bulk of the window lifter 40.

According to the second of these alternative embodiments, the holder 68 fastens the cable 56 to the outside of the parallelogram. The cable 56 then extends between the two corresponding ends of the first and second guide rails 42 and 44 while bypassing the opposite end of the first guide rail 42. In other words, the cable system 54 extends between the pulleys 46 and 52 while passing to the outside of the parallelogram, beyond the rail 42, or even beyond the pulley 48. Preferably, the first guide rail 42 can then have an additional fastening point at the pulley 48 to fasten the cable system 54 passing beyond the pulley 48.

The second of these alternative embodiments makes it possible for the space separating the first guide rail 42 from the second guide rail 44 to be freed from the passage of the cable 56. Furthermore, when the holder 68 also performs the platen function to support the geared motor, the second of these alternative embodiments has the advantage of making it possible to position the geared motor 76 at the outside of the first guide rail 42. In other words, the geared motor 76 can advantageously be positioned not to protrude to the inside of the parallelogram. The space separating the first guide rail 42 from the second guide rail 44 is then freed from the geared motor 76. The freeing of the space separating the first guide rail 42 from the second guide rail 44 allows free positioning of parts outside the window lifter 40. Furthermore, in this embodiment, when the window lifter is mounted in the door of the vehicle with the first guide rail 42 arranged as close as possible to the hinge of the door, the forces undergone by the geared motor 76 are also reduced during slamming closure of the door.

As one non-limiting illustration, in the continuation of the description, reference is made to the one alternative embodiment in which the holder 68 is provided to fasten the cable inside the parallelogram.

Returning to FIG. 2, in addition to the cable 56, the cable system 54 comprises an additional cable 58 between the sliders 66 of the second guide rail 44 and the drum 62. The illustrated cable system 54 also comprises a third cable 60 between the slider 64 of the first guide rail 42 and the drum 62. The cable 56 connects the two sliders 66 and 68 to each other. Thus, the cable system 54 is fastened to each of the sliders 64 and 66 and to the drum 62 while forming a closed cable circuit, to transmit the movement of the drum 62 to the sliders 64 and 66 both while opening and closing the window. Rotating the drum 62 in one direction or the other allows winding of the cable 58 or 60 around the drum 62, thereby driving the movement of the sliders 64 and 66.

The cables 56 and 58 intersect such that, during driving by the drum 62, the sliders 64 and 66 are moved in the same direction. The intersection of the cables 56 and 58 gives the cable system 54 substantially the shape of an "X". The window lifter 40 is then of the so-called "X" type. The intersection of the cables 56 and 58 is advantageously done at the holder 68 of the window lifter 40. In this way, the holder 68 can incorporate a function of guiding the cables 56 and 58 while procuring a limitation of the lateral movement of those two cables 56 and 58.

To facilitate the guiding of the cable system, the cables 56 and 58 can be cables of the "Bowden" type, i.e., having a sheath 70 and 72, respectively. Along the sheath, the cables 56 and 58 can thus have a curved trajectory while being kept tighten.

It is advantageous for cost and simplicity reasons of the system for the portion of the cable 56 extending between the holder 68 and the end of the first guide rail 42 not to have a sheath. The cost of the sheath in fact depends on the length used in the system. In compliance with FIG. 2, the trajectory of that tensed portion is rectilinear between the holder 68 and the pulley 46 due to the absence of sheath on that portion of the cable 56. The sheath 70 of the cable 56 can therefore stop at the holder 68, which advantageously incorporates a cable stop 74 for stopping the sheath of the cable 56. In this case, the end of the first guide rail supporting the pulley 46 does not have a cable stop. Likewise, the sheath 72 of the cable 58 can extend from the pulley 50 and stop at the holder 68. The holder 68 then advantageously incorporates a cable stop 78 for the sheath 72.

It is preferable for the positioning of the holder 68 on the first guide rail 42 to ensure that the fastening of the cable 56 is arranged as close as possible to the middle of the cable 56 connecting the two corresponding ends of the first and second guide rails 42 and 44. For example, the portion of the cable 56 extending between the holder 68 and the end of the first guide rail 42 has a length greater than or equal to 1/10 of the length of the portion of the cable 56 connecting the two ends of the first and second guide rails 42 and 44. The portion of the cable 56 extending between the holder 68 and the end of the first guide rail 42 can also have a length greater than or equal to one quarter of the length of the portion of the cable 56 connecting the two ends of the first and second guide rails 42 and 44.

This embodiment also has the advantage that at least one quarter of the length of the cable 56 between the pulleys 46 and 52 of the corresponding ends of the guide rails 42 and 44 is provided with no sheath.

To allow both fastening as close as possible to the middle of the cable 56 and a decreased length of the holder 68, it is preferable for the holder 68 to extend in a direction perpendicular to the driving direction of the window, previously defined. In general, the holder 68 is in particular separate from the portions in the vicinity of the ends of the guide rail. As an illustration, FIG. 2 in particular shows that the distance separating the holder 68 from one end of the first guide rail 42 may be greater than or equal to one quarter of the length of the first guide rail 42.

Of course, the present invention is not limited to the examples and embodiments described and shown, but is open to many alternatives accessible to those skilled in the art.

In particular, the drum 62 can be driven manually by means of a handle connected to the drum 62.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A window lifter comprising:

a first guide rail and a second guide rails, the first guide rail having an upper pulley located proximate to an upper end of the first guide rail and a lower pulley located proximate to a lower end of the first guide rail, and wherein the second guide rail has an upper pulley located proximate to an upper end of the second guide rail and a lower pulley located proximate to a lower end of the second guide rail;

first and second sliders for driving a window, the first and second sliders being guided in translation by the first guide rail and the second guide rail, respectively;

a cable system for driving the sliders along the first and second guide rails, the cable system comprising a first cable extending at least between the upper pulley of the first guide rail and the lower pulley of the second guide rail; and a holder integrally formed with the first guide rail, the holder being located between the upper end and the lower end of the first guide rail, wherein the holder is configured to have a sheath stop for engaging an end of a sheath of the first cable, wherein the sheath of the first cable only extends from the holder to the lower pulley of the second guide rail such that a portion of the first cable extending from the holder towards the upper pulley of the first guide rail is not covered by the sheath of the first cable and wherein the portion of the first cable extending from the holder towards the upper pulley of the first guide rail that is not covered by the sheath of the first cable is not covered by any cable sheath, and further comprising a drum configured for engaging the cable system and for driving the first and second sliders by the cable system, and wherein the cable system further comprises a second cable extending between the second slider of the second guide rail and the drum, the first cable and the second cable intersecting each other at the holder, wherein the first cable does not engage the drum.

2. The window lifter according to claim 1, wherein the portion of the first cable extending from the holder that is not covered by the sheath of the first cable has a length of at least 1/10 of a length of the first cable covered by the sheath and less than the length of the first cable covered by the sheath.

3. The window lifter according to claim 1, wherein the first guide rails and the second guide rail define a driving direction of the window, the holder extending away from the first guide rail in a direction perpendicular to the driving direction of the window.

4. The window lifter according to claim 1, wherein the first guide rail and the second guide rails define, in an operating position of the window lifter, opposite sides of a parallelogram, the holder being located within a periphery of the parallelogram.

5. The window lifter according to claim 1, wherein the first guide rail and the second guide rails define, in an operating position of the window lifter, opposite sides of a parallelogram, the holder being located outside a periphery of the parallelogram.

6. The window lifter according to claim 1, wherein the drum is arranged on the first guide rail at the holder.

7. The window lifter according to claim 6, wherein the holder is configured for supporting a geared motor for driving the drum.

8. The window lifter according to claim 1, wherein a distance separating the holder from one end of the first guide rail is greater than or equal to one quarter of a length of the first guide rail and less than the length of the first guide rail.

9. The window lifter according to claim 1, wherein the first and second guide rails are separate pieces.

10. The window lifter as in claim 1, wherein the window lifter further comprises another sheath extending from the holder to the upper pulley of the second guide rail, the another sheath configured to cover a portion of the second cable that extends from the holder to the upper pulley of the second guide rail, wherein the holder further comprises another sheath stop configured to engage an end of the another sheath.

11. The window lifter as in claim 1, wherein the first guide rail and the second guide rail define, in an operating position of the window lifter, opposite sides of a parallelogram.

12. A vehicle door including an inner door shell, a window and a window lifter, the window lifter comprising:

a first guide rail and a second guide rails, the first guide rail having an upper pulley located proximate to an upper end of the first guide rail and a lower pulley located proximate to a lower end of the first guide rail, and wherein the second guide rail has an upper pulley located proximate to an upper end of the second guide rail and a lower pulley located proximate to a lower end of the second guide rail;

first and second sliders for driving the window, the first and second sliders being guided in translation by the first guide rail and the second guide rail, respectively;

a cable system for driving the sliders along the first and second guide rails, the cable system comprising a first cable extending at least between the upper pulley of the first guide rail and the lower pulley of the second guide rail; and a holder integrally formed with the first guide rail, the holder being located between the upper end and the lower end of the first guide rail, wherein the holder is configured to have a sheath stop for engaging an end of a sheath of the first cable, wherein the sheath of the first cable only extends from the holder to the lower pulley of the second guide rail such that a portion of the first cable extending from the holder to the upper pulley of the first guide rail is not covered by the sheath of the first cable and wherein the portion of the first cable extending from the holder that is not covered by the sheath of the first cable is not covered by any cable sheath, wherein the window lifter is mounted in the inner door shell of the vehicle so as to drive the closing and opening movement of the window, and wherein the window lifter further comprises another sheath extending from the holder to the upper pulley of the second guide rail, the another sheath configured to cover a portion of a second cable that extends from the holder to the upper pulley of the second guide rail, wherein the holder further comprises another sheath stop configured to engage an end of the another sheath.

13. The vehicle door according to claim 12, wherein the cables are fastened to the inner door shell only by the first guide rail and the second guide rail.

14. The vehicle door as in claim 12, wherein the first guide rail and the second guide rail define, in an operating position of the window lifter, opposite sides of a parallelogram.

15. The vehicle door as in claim 14, wherein the cables are fastened to the inner door shell only by the first guide rail and the second guide rail.

16. A window lifter comprising:

a first guide rail and a second guide rails, the first guide rail having an upper pulley located proximate to an upper end of the first guide rail and a lower pulley located proximate to a lower end of the first guide rail, and wherein the second guide rail has an upper pulley located proximate to an upper end of the second guide rail and a lower pulley located proximate to a lower end of the second guide rail;

first and second sliders for driving a window, the first and second sliders being guided in translation by the first guide rail and the second guide rail, respectively;

a cable system for driving the sliders along the first and second guide rails, the cable system comprising a first cable extending at least between the upper pulley of the first guide rail and the lower pulley of the second guide rail:

a holder integrally formed with the first guide rail, the holder being located between the upper end and the lower end of the first guide rail, wherein the holder is configured to have a sheath stop for engaging an end of a sheath of the first cable, wherein the sheath of the first cable only extends over a portion of the first cable that extends from the holder to the lower pulley of the second guide rail and a portion of the first cable that extends from the holder to the upper pulley of the first guide rail is not covered by the sheath or any other cable sheath; and a drum configured for engaging the cable system and for driving the first and second sliders by the cable system, wherein the cable system further comprises a second cable extending between the second slider of the second guide rail and the drum by way of the upper pulley of the second guide rail, wherein the first cable and the second cable intersecting each other at the holder.

17. The window lifter as in claims 16, wherein the first guide rail and the second guide rails define, in an operating position of the window lifter, opposite sides of a parallelogram, wherein the holder is located within a periphery of the parallelogram.

18. The window lifter as in claim 16, wherein a distance separating the holder from one end of the first guide rail is greater than or equal to one quarter of a length of the first guide rail and less than the length of the first guide rail.

19. The window lifter as in claim 16, wherein the window lifter further comprises another sheath extending from the holder to the upper pulley of the second guide rail, the another sheath configured to cover a portion of the second cable that extends from the holder to the upper pulley of the second guide rail, wherein the holder further comprises another sheath stop configured to engage an end of the another sheath and wherein the cable system further comprises a third cable that extends from the drum to the first slider of the first guide rail by way of the lower pulley of the first guide rail and wherein the first cable is operatively coupled to the first slider and the second slider by way of the upper pulley of the first guide rail and the lower pulley of the second guide rail and wherein the first cable does not engage the drum.

20. The window lifter as in claim 17, wherein the first guide rail and the second guide rail define, in an operating position of the window lifter, opposite sides of a parallelogram.

* * * * *